United States Patent [19]

Young et al.

[11] Patent Number: 4,494,463

[45] Date of Patent: Jan. 22, 1985

[54] RAIL FASTENER APPLICATOR

[75] Inventors: Hartley F. Young, Victoria; Wally A. Remes; John L. Collins, both of Adelaide, all of Australia

[73] Assignee: Ralph McKay Limited, Maidstone, Australia

[21] Appl. No.: 410,649

[22] Filed: Aug. 23, 1982

[30] Foreign Application Priority Data

Sep. 1, 1981 [AU] Australia ..... PF0537

[51] Int. Cl.[3] ..... E01B 29/24

[52] U.S. Cl. ..... 104/17 A; 29/243.5; 29/252; 29/283.5; 104/1 R

[58] Field of Search ..... 104/17 A, 17 R, 1 R, 104/16; 238/349, 351; 29/243.5, 252, 283.5

[56] References Cited

U.S. PATENT DOCUMENTS

| | | | |
|---|---|---|---|
| 3,841,221 | 10/1974 | Dieringer et al. | 104/17 A |
| 4,068,593 | 1/1978 | Leeves | 104/17 A X |
| 4,178,671 | 12/1979 | Luttig | 104/16 X |
| 4,367,682 | 1/1983 | Freilich et al. | 104/17 A |

*Primary Examiner*—Randolph Reese

*Attorney, Agent, or Firm*—Christel, Bean & Linihan

[57] ABSTRACT

Apparatus for applying elastic rail fasteners to a rail seat in which the fasteners are applied in a direction at right angles to the rail. A carriage supports a pivoted frame which can be rotated to align with a rail tie. Each end of the frame carries a pair of dependent arms and each pair is moved hydraulically. Abutment faces on the ends of the dependent arms contact the rail fasteners and the simultaneous contraction of each pair results in the fitting of four rail fasteners in one application. Rail tie position sensors are provided adjacent the abutment faces for correctly aligning the frame with the rail tie.

4 Claims, 3 Drawing Figures

RAIL FASTENER APPLICATOR

Figure 1:
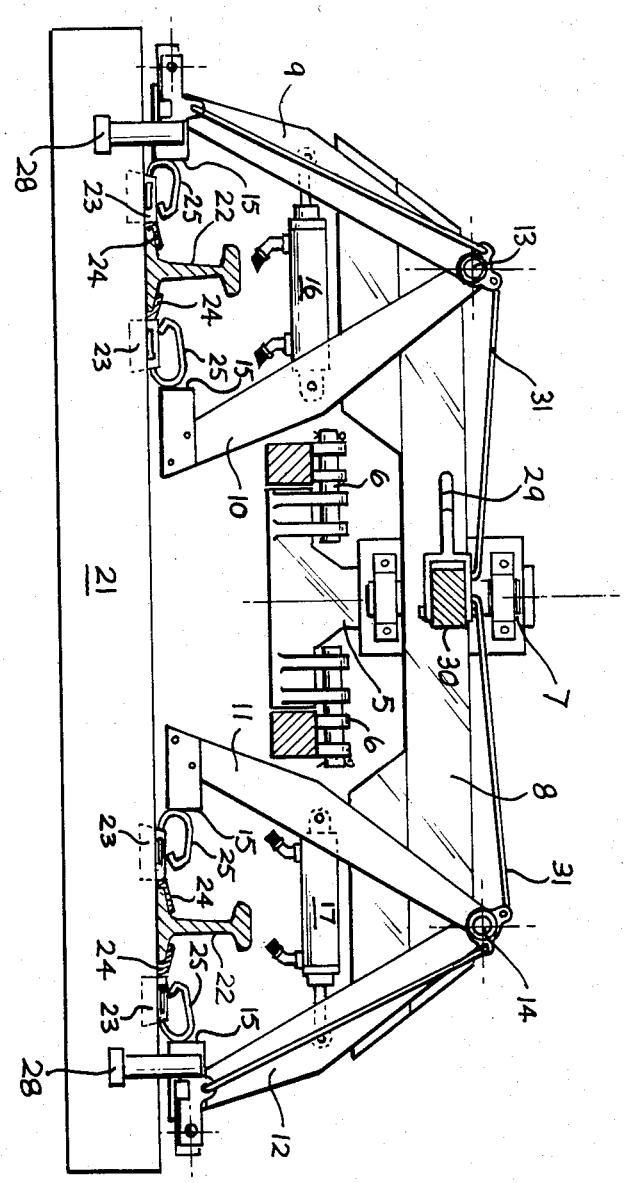

This invention relates to apparatus for applying rail fastening devices to anchor rails to rail ties. In particular it is concerned with applying fasteners that are applied in a direction parallel to the rail tie and at right angles to the rail.

For a pair of rails each tie accommodates four fasteners (two to a rail) which are held in position by support shoulders embedded or secured to the rail tie. Each pair of support shoulders are located on opposite sides of a rail which lies between them. Insulator pads are placed on the rail flange to insulate the rail from the support shoulders and the fastener. The fastener when in position is held by the support shoulder and one end lies on the rail flange imparting a holding down force.

Conventional practice with this type of rail fastener is to apply the fasteners singly or in pairs that is a pair of opposing fasteners are applied simultaneously to one rail. One such dual applicator in use comprises a pair of arms pivoted separately intermediate their ends, and a support beam and connected at one end by a hydraulic ram located above said beam so that the free ends can be moved together to apply a pair of fasteners. This applicator is positioned over a rail and the arms extend down beside the rail to abut the fasteners. Also in this applicator the two arms are linked by a gear arrangement to ensure that the two arms move progressively inward at the same rate.

It is important in laying rail tracks to reduce the time taken to apply the fasteners. Conventionally the rail ties are laid in ballast with the support shoulders secured thereto, the rails are laid between opposing pairs of support shoulders and the rail fasteners are placed abutting the support shoulders in the initial application position. It is important therefore that the last step of applying the fasteners is carried out quickly.

It is an object of this invention to provide apparatus which applies fasteners to rails quickly without causing undue stress or damage to the fasteners, insulators or support shoulders.

To this end the present invention provides a rail fastener applicator comprising a carrier, a frame on said carrier adapted to span two rails, a pair of pivotted arms at either end of said frame said arms being dependent from said frame and each arm terminating in abutment faces each of which is adapted to contact a rail fastener, means to move said arms in unison such that the abutment faces on each pair of arms either move toward or away from each other, and said frame being pivoted to enable rotation of said frame in a horizontal plane.

This arrangement allows the four fasteners on each rail tie to be applied simultaneously and at least doubles the speed of application of the fasteners compared to the prior art. The carrier is conveniently a wheeled chassis adapted to run on the rails and the frame is conveniently positioned transversely of the carrier spanning the rails. Because the rail ties may not be precisely at right angles to the rails it is essential for the frame to be pivotted to enable the frame to be aligned parallel to the rail tie and to thus ensure contact of the four abutment faces with the four rail fasteners on the rail tie.

To apply the fasteners onto the support shoulders and rails a steady application force is required which should not be too great, to avoid damage to the fasteners or the insulators. This is preferably achieved by hydraulic pressure applied to a ram secured between each pair of arms below their pivots. The arms can be independently mounted on the frame or each pair may be linked by a common pivot pin. The length of the arms determines the degree of arc in the movement of the abutment faces required to apply the fasteners. It is preferred to have long arms to ensure a relatively flat arc for the travel of the abutment faces and thus avoid too much downward pressure on the fasteners.

By avoiding any other linkage of the two arms, in each pair of arms, there is an unexpected improvement in ease of application. The same hydraulic pressure is applied to each pair of arms and thus the application pressure of each abutting face is identical. However as the arms are free to move independently if one fastener is difficult to apply, the other fasteners will be forced into place first, and consequently the difficult fastener is more easily pushed into place by the full force of the hydraulic pressure. Also the vibratory movement of four fasteners being applied at once increases the ease of application. A further advantage is that where the rail tie is lower than the rail and there is a clearance, the applicator of this invention, because it applies pressure equally to all four fasteners tends to raise the rail tie closer to the rail to facilitate fitting of the fastener. In prior art applicators where the fasteners were only applied to one rail at a time this advantage was not available because the forces involved were insufficient to provide any lifting force to the rail tie.

Figure 2:
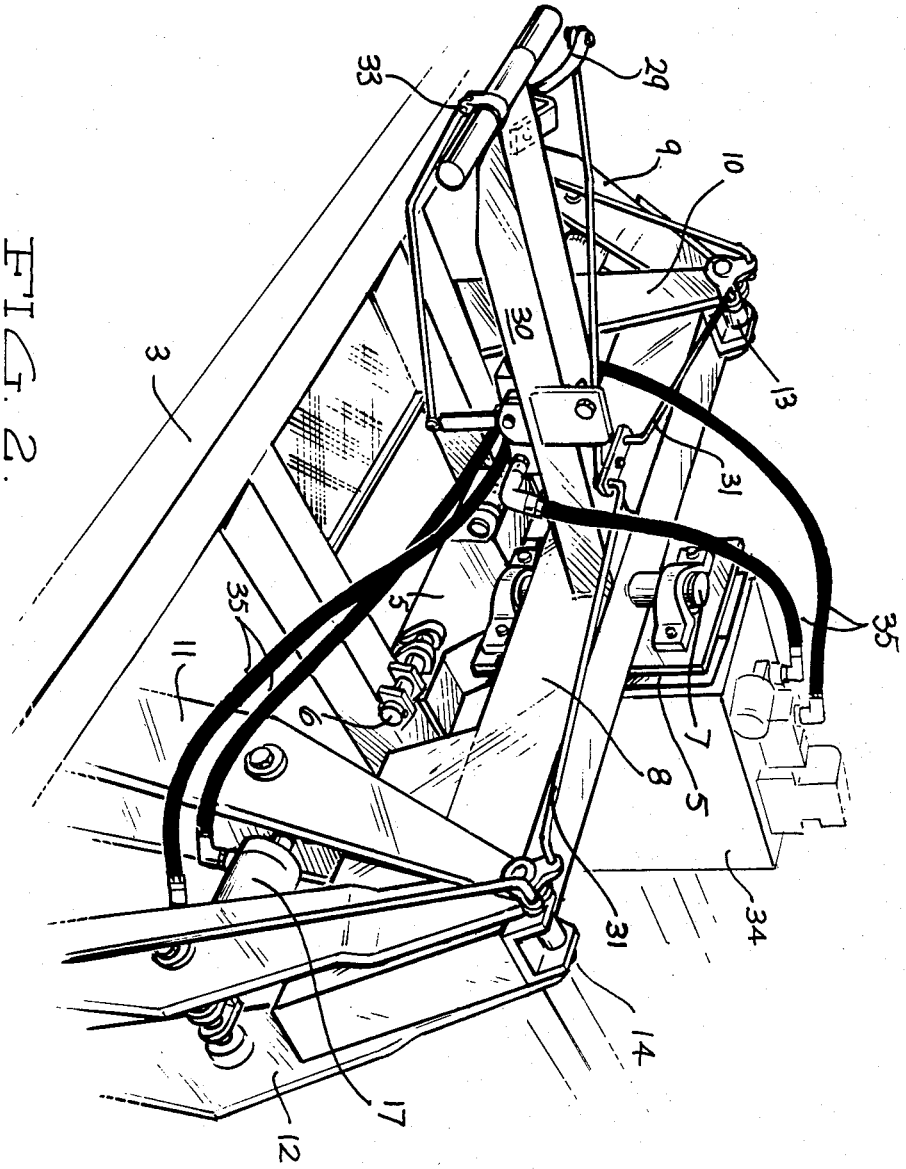
Figure 3:
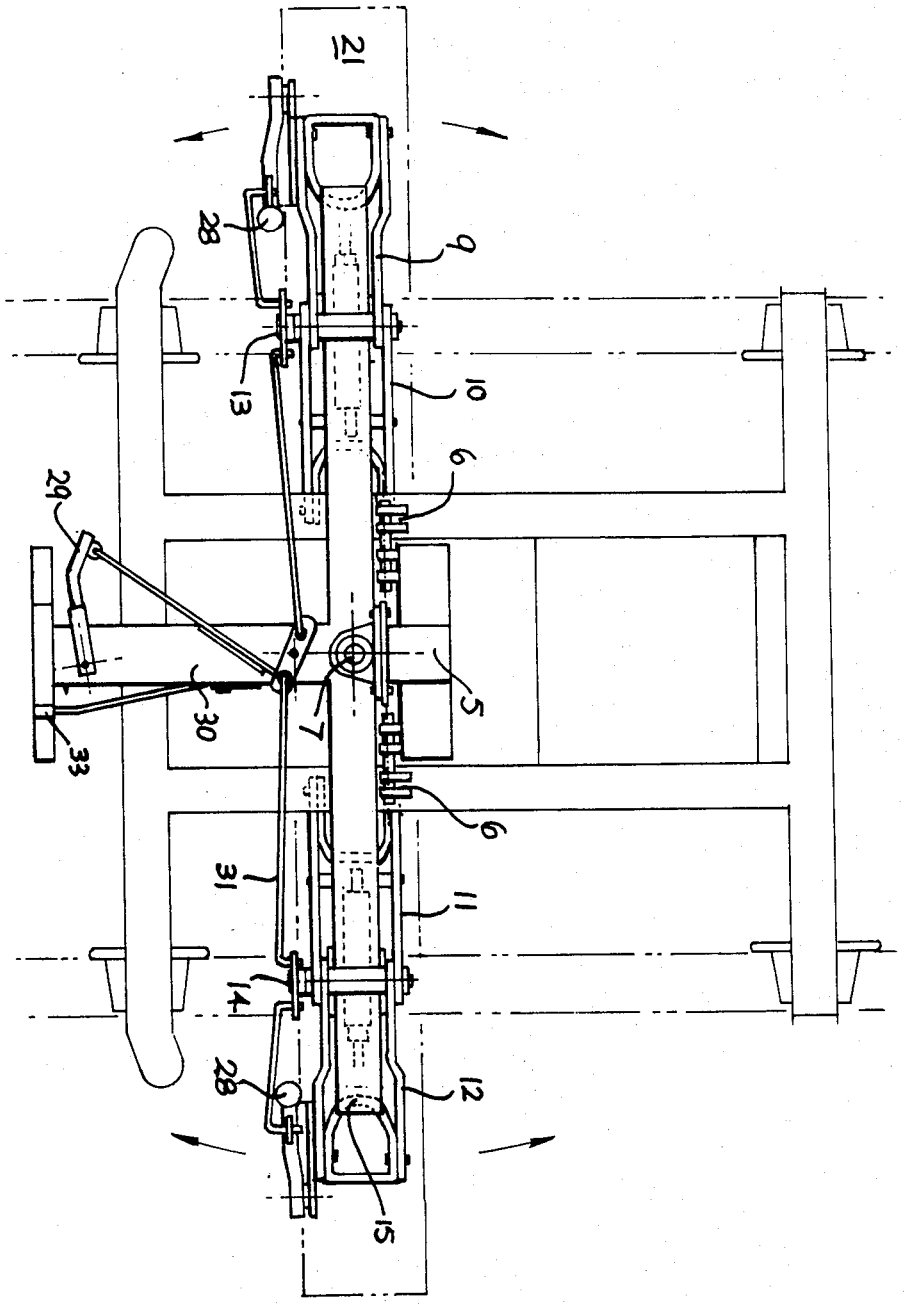

A preferred form of this invention will now be described with reference to the drawings in which FIG. 1 is an end sectional view of the essential components of an applicator of this invention and FIG. 2 is a perspective view of the upper section of the applicator frame and FIG. 3 is a plan view of the applicator.

The applicator apparatus comprises a carrier 3 which is mounted on wheels (not shown) that run on the rails. Mounted on the carrier 3 is a support column 5 and hinged thereto by hinges 6. A frame 8 is mounted on the vertical pivot pin 7 which is attached to the column 5. The frame 8 extends transversely of the carrier 3 and is able to be aligned parallel with the rail tie 21 by rotation about the pivot pin 7.

In FIG. 1 the applicator is shown in position over a rail tie 21 having two rails 22 lying thereon. Each rail 22 lies between opposing support shoulders 23 with rail insulator pads 24 interposed between the shoulders and the flange of rails 22. The rail fasteners 25 are shown in their initial position prior to being pushed into the support shoulders 23 so that a portion of the rail fastener 25 lies on the insulator pad 24 to apply clamping force to the rail 22.

The rail fastener and support shoulders are preferably those described in Australian patent applications Nos. 37379/78, 47881/79, 54004/79 and 60581/79. The fastener and shoulder as described in Australian patent applications Nos. 45550/79 and 47039/79 or in 53946/79 are also suitable for use with this invention.

At the ends of frame 8 a pair of arms 9, 10, 11 and 12 are disposed joined by common pivots 13 and 14. Each of the arms 9, 10, 11 and 12 extends downwardly to terminate in abutment faces 15 adjacent the surface of the rail tie 21. Each abutment face 15 of the arms 9, 10, 11 and 12 abuts a corresponding rail fastener 25.

Intermediate their ends arms 9 and 10 and 11 and 12 are linked by a hydraulic ram 16 and 17 respectively which acts to pull each pair of arms inwardly or push them apart. When the arms 9, 10, 11 and 12 are respectively pulled toward each other the fasteners 25 are each pushed by the abutment faces 15 into the shoulders 23 so that the ends of the fasteners 25 lie on the insulator pads 24 on the flanges of rails 22.

To assist in alignment of the frame 8 to ensure that each abutment face 15 is in contact with its corresponding fastener 25 stops 28 are provided. These stops abut against the rail tie 21 and ensure that the frame 8 pivots on pivot pin 7 to align parallel to rail tie 21. When the carrier is moved to the next successive rail tie the operator (not shown) pulls lever 29 on the control column 30 which by a rod linkage 31 raises the stop 28 to clear the rail tie. The lever 29 can then be released to ensure alignment of the frame 8 with the successive rail tie.

The hydraulic rams 16 and 17 are actuated by lever 33 on control column 30. The rams 16 and 17 are connected to a conventional hydraulic pump 34 by fluid lines 35. To ensure that excessive pressure is not applied to the rail fasteners an excess pressure bleed valve is incorporated in the system. This is designed to select a pressure sufficient to achieve application of fasteners 25 but which is insufficient to cause stress or break down of the fasteners 25, insulators 24 or shoulders 23.

When the applicator is not in use the frame and column 5 can be folded into a horizontal position by virtue of the hinge 6. This ensures that the arms 9, 10, 11 and 12 are located out of the way during transport of the carrier.

From the above it can be seen that this invention provides an improved applicator for rail fasteners that is capable of increasing the speed and ease of fitting rail fasteners.

We claim:

1. A rail fastener applicator for use with rail fasteners which are applied horizontally in a direction at right angles to the longitudinal dimension of the rail comprising a carrier, a frame on said carrier adapted to span two rails, a pair of pivoted arms at either end of said frame, said arms being independent from said frame and pivoted to move in a plane perpendicular to the longitudinal dimension of said rails, each arm terminating in abutment faces each of which is adapted to contact an individual rail fastener, means to move said arms in unison such that the abutment faces on each pair of arms either move toward each other to apply a pair of rail fasteners or move away from each other, and said frame being pivoted to enable rotation of said frame in a horizontal plane.

2. A rail fastener applicator as claimed in claim 1 in which said carrier is mounted for traction on said rails.

3. A rail fastener applicator as claimed in claim 1 in which rail tie sensing means are located adjacent each pair of abutment faces to orient the frame parallel to the rail tie.

4. A rail fastener applicator as claimed in claim 1 in which hydraulic means are used to move said arms and said hydraulic means are limited to a maximum application force.

* * * * *